US007308930B2

(12) United States Patent
Huffman et al.

(10) Patent No.: US 7,308,930 B2
(45) Date of Patent: Dec. 18, 2007

(54) METHOD OF CONTINUOUS CASTING STEEL STRIP

(75) Inventors: John Huffman, Bainbridge, IN (US); Brian Bowman, Waveland, IN (US); Jason Gilliland, Crawfordsville, IN (US); Chad Slavens, Crawfordsville, IN (US)

(73) Assignee: Nucor Corporation, Charlotte, NC (US)

( * ) Notice: Subject to any disclaimer, the term of this patent is extended or adjusted under 35 U.S.C. 154(b) by 0 days.

(21) Appl. No.: 11/371,381

(22) Filed: Mar. 9, 2006

(65) Prior Publication Data

US 2007/0209777 A1 Sep. 13, 2007

(51) Int. Cl.
*B22D 11/06* (2006.01)

(52) U.S. Cl. ..... 164/480; 164/428

(58) Field of Classification Search ..... 164/428, 164/480

See application file for complete search history.

(56) References Cited

U.S. PATENT DOCUMENTS 5,638,892 A 6/1997 Barbe et al.
5,787,968 A 8/1998 Lauener
5,915,454 A 6/1999 Wright et al.
5,927,375 A 7/1999 Damasse et al.
2006/0102312 A1 5/2006 Poloni et al.

FOREIGN PATENT DOCUMENTS

| | | |
|---|---|---|
| EP | 0 546 206 | 7/1997 |
| EP | 0 782 894 | 7/1997 |
| GB | 2 296 883 | 7/1997 |
| JP | 63-036954 | 2/1988 |
| JP | 63-177944 | 6/2007 |
| KR | 2003017105 | 3/2003 |
| WO | 99/32247 | 7/1999 |
| WO | 2005/002757 | 1/2005 |
| WO | 2005/023458 | 3/2005 |
| WO | 2005/025773 | 3/2005 |

OTHER PUBLICATIONS

PCT/AU2007/000288 International Search Report.
PCT/AU2007/000288 Written Opinion.

*Primary Examiner*—Kuang Lin
(74) *Attorney, Agent, or Firm*—Hahn Loeser & Parks LLP; Arland T. Stein

(57) ABSTRACT

A method of continuously casting thin strip where, at the start of a casting campaign, the side dams are pressed against the end surfaces of the casting rolls with a pressure of less than 3.0 kg/cm$^2$ but more than 1.25 kg/cm$^2$ and after the target casting pool height is reached, reducing the pressure exerted by the side dams against the end surfaces of the casting rolls to below 1.25 kg/cm$^2$ to reduce wear of the side dams against the end surfaces of the casting rolls.

8 Claims, 4 Drawing Sheets

METHOD OF CONTINUOUS CASTING STEEL STRIP

BACKGROUND AND SUMMARY OF THE INVENTION

This invention relates to continuous casting of thin steel strip in a twin roll caster. More specifically, this invention relates to the operation of and reduction of wear in side dams.

In a twin roll caster, molten metal is introduced between a pair of contra-rotated horizontal casting rolls which are internally cooled so that metal shells solidify on the moving roll surfaces and are brought together at the nip between them to produce a thin cast strip product, delivered downwardly from the nip between the casting rolls. The term "nip" is used herein to refer to the general region at which the casting rolls are closest together. The molten metal may be poured from a ladle through a metal delivery system comprised of a tundish and a core nozzle located above the nip, to form a casting pool of molten metal supported on the casting surfaces of the rolls above the nip and extending along the length of the nip. This casting pool is usually confined between refractory side plates or dams held in sliding engagement with the end surfaces of the rolls so as to dam the two ends of the casting pool against outflow.

When casting steel strip in a twin roll caster, the thin cast strip leaves the nip at very high temperatures, of the order of 1400° C. If exposed to normal atmosphere, it will suffer very rapid scaling due to oxidation at such high temperatures. A sealed enclosure is therefore provided beneath the casting rolls to receive the hot cast strip, and through which the strip passes away from the strip caster, which contains an atmosphere that inhibits oxidation of the strip. The oxidation inhibiting atmosphere may be created by injecting a non-oxidizing gas, for example, an inert gas such as argon or nitrogen, or combustion exhaust reducing gases. Alternatively, the enclosure may be sealed against ingress of an ambient oxygen-containing atmosphere during operation of the strip caster, and the oxygen content of the atmosphere within the enclosure reduced, during an initial phase of casting, by allowing oxidation of the strip to extract oxygen from the sealed enclosure as disclosed in U.S. Pat. Nos. 5,762,126 and 5,960,855.

The length of the casting campaign has been generally determined in the past by the wear cycle on the core nozzle, tundish and side dams. Multi-ladle sequences can be continued so long as the source of hot metal supplies ladles of molten steel, which can be transferred into and out of the operating position by use of a turret. Therefore, the focus of attention to lengthen casting campaigns has been extending the life cycle of the core nozzle, tundish and side dams. When a nozzle, tundish or side dam wears to the point that it has to be replaced, the casting campaign has to be stopped, and the worn out component replaced. This would generally require removing unworn components as well since otherwise the length of the next campaign would be limited by the remaining useful life of the worn but not replaced refractory components, with attendant waste of useful life of refractories and increased cost of casting steel. Further, all of the refractory components would have to be preheated before the next casting campaign can start. Graphitized alumina, boron nitride and boron nitride-zirconia composites are examples of suitable refractory materials for metal delivery components. Since the core nozzle, tundish and side dams all have to be preheated to very high temperatures approaching that of the molten steel, there can be considerable waste of casting time between campaigns. See U.S. Pat. Nos. 5,184,668 and 5,277,243.

The present invention limits down time for changes of worn refractory components, decreases waste of useful life of refractory components, reduces energy needs in casting, and increases casting capacity of the caster. Useful life of refractories can be increased, and reheating of unreplaced refractory components can be avoided or minimized. The core nozzle must be put in place before the tundish, and conversely the tundish must be removed before core nozzle can be replaced, and both of these refractory components wear independently of each other. Similarly, the side dams wear independently of the core nozzles and tundish, and independently of each other, because the side dams must initially be urged against the ends of the casting rolls under applied forces, and "bedded in" by wear so as to ensure adequate sealing against outflow of molten steel from the casting pool. The forces applied to the side dams may be reduced after an initial bedding-in period, but will always be such that there is significant wear of the side dams throughout the casting operation. For this reason, the core nozzle and tundish in the metal delivery system can have a longer life than the side dams, and can normally continue to be operated through several more ladles of molten steel supplied in a campaign. Thus the duration of a casting campaign is usually determined by the rate of wear of the side dams however the tundish and core nozzle, which still have useful life, are often changed when the side dams are changed to increase casting capacity of the caster. No matter which refractory component wears out first, a casting run will need to be terminated to replace the worn out component. Since the cost of thin cast strip production is directly related to the length of the casting time, unworn components in the metal delivery system are generally replaced before the end of their useful life as a precaution to avoid further disruption of the next casting campaign, with attendant waste of useful life of refractory components.

By the present invention, it is possible to extend casting campaign lengths by minimizing side dam wear and thus, reducing waste of refractory components, operating costs and increasing casting time.

A method of continuous casting thin strip is disclosed comprising the steps of:

a. assembling a pair of casting rolls laterally positioned to form casting pool of molten supporting on casting surfaces of the casting rolls confined by side dams adjacent opposite ends surfaces of the casting rolls metal, and a nip between the casting rolls through which cast strip can discharge downwardly, b. at the start of a casting campaign, pressing the side dams against the end surfaces of the casting rolls such that the side dams exert a pressure against the end surfaces of the casting rolls of less than 3.0 kg/cm$^2$ but more than 1.25 kg/cm$^2$, and c. after the target casting pool height is reached, reducing the pressure exerted by the side dams against the end surfaces of the casting rolls to below 1.25 kg/cm$^2$ to reduce wear of the side dams against the end surfaces of the casting rolls, while resisting ferrostatic pressure from the casting pool.

At the start of a casting campaign, the pushing force may be greater than 1.5 kg/cm$^2$ or greater than 1.9 kg/cm$^2$. After the target casting pool height is reached, the pressure exerted by the side dams against the end surfaces of the casting rolls may be below 0.5 kg/cm$^2$ or below 0.25 kg/cm$^2$.

The wear rate of the side dams during casting after the target pool height is reached may range from 0.0001 mm/sec to 0.005 mm/sec, or may range from 0.0008 mm/sec to 0.0032 mm/sec.

BRIEF DESCRIPTION OF THE DRAWINGS

The operation of an illustrative twin roll installation in accordance with the present invention will now be described with reference to the accompanying drawings in which.

DETAILED DESCRIPTION OF THE INVENTION

Figure 1:
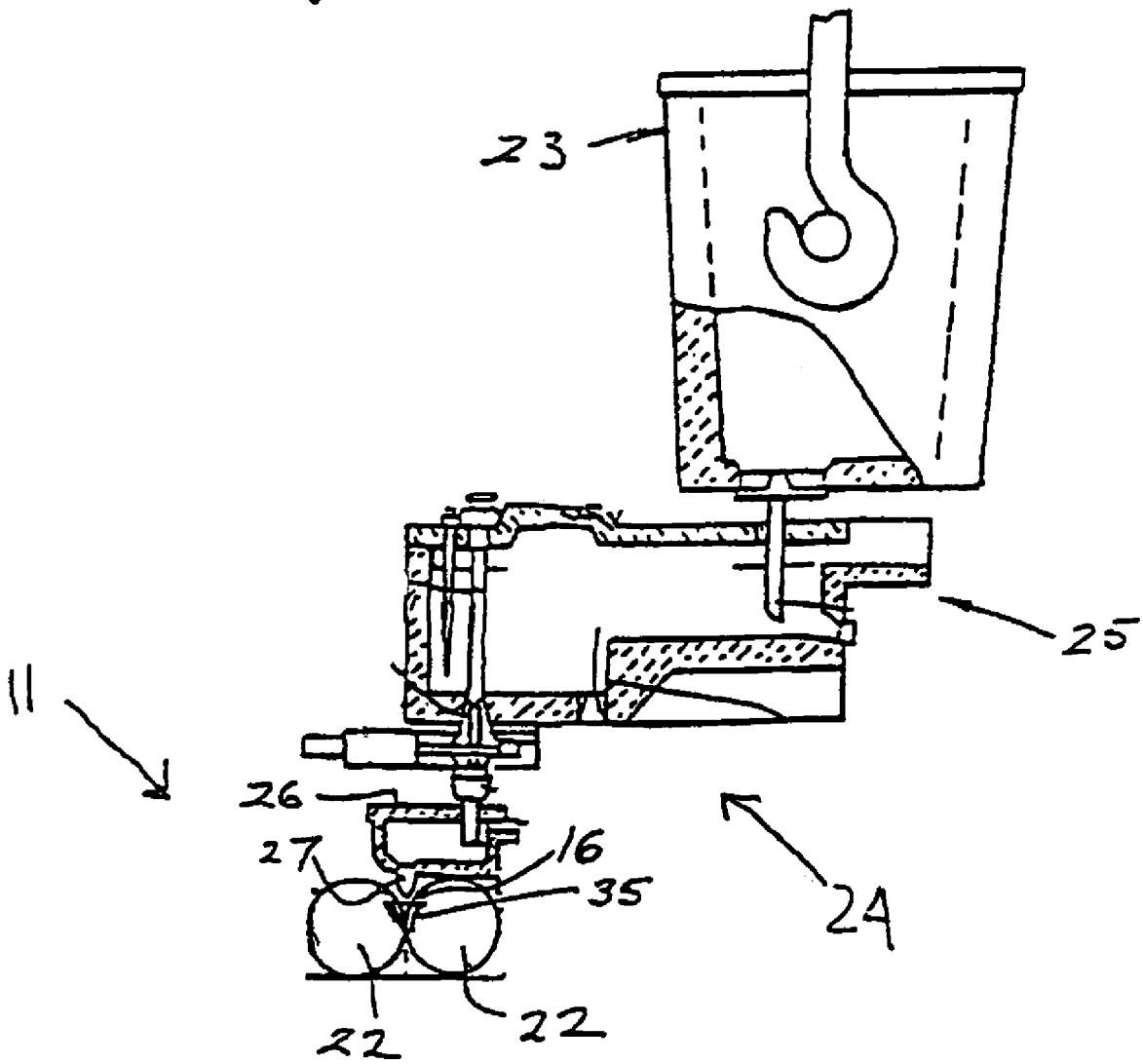
FIG. 1 is a side view of an illustrative twin roll caster.
Figure 2:
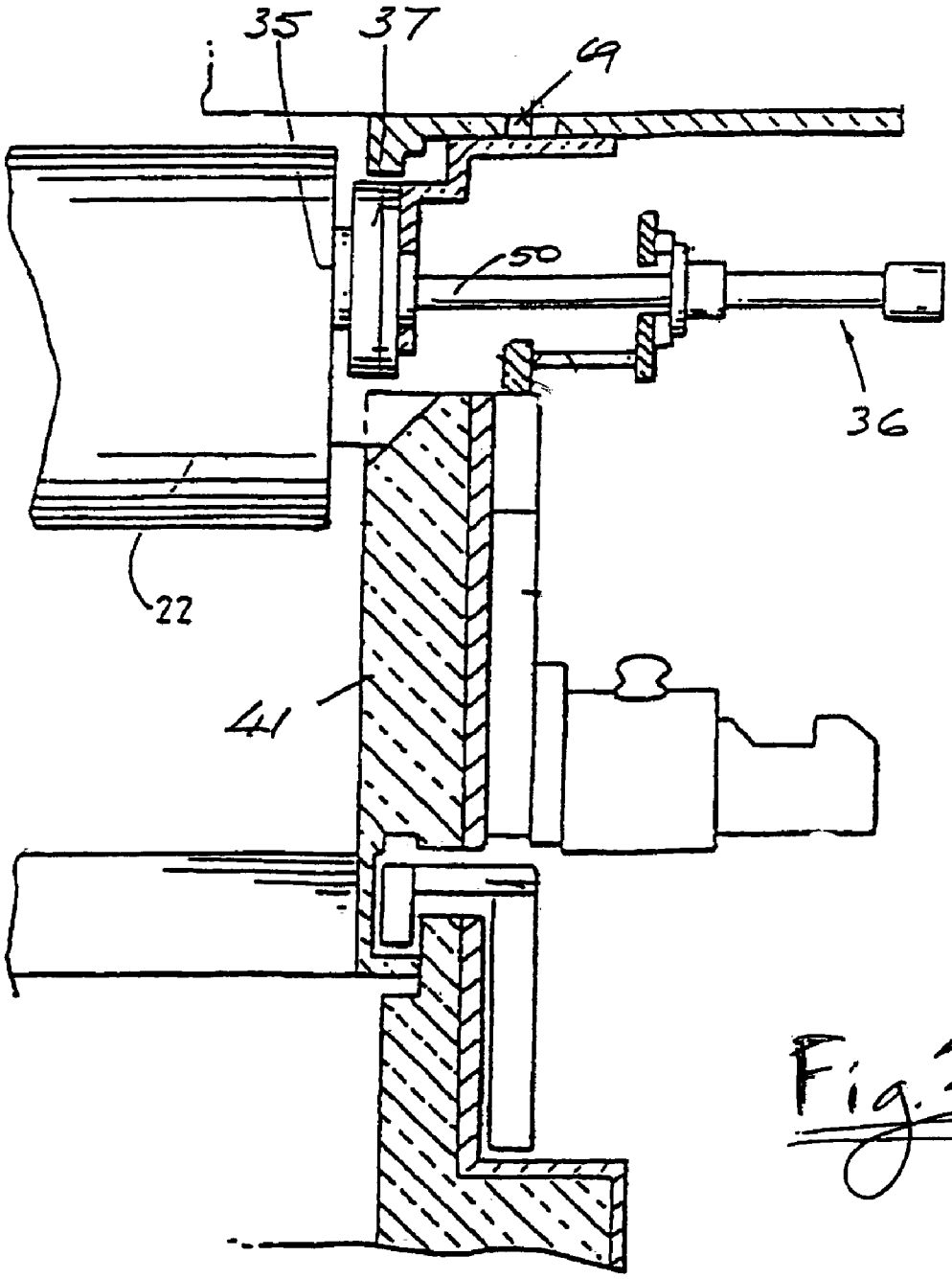
FIG. 2 is a side view of the side dam area of the caster shown in FIG. 1.
Figure 3:
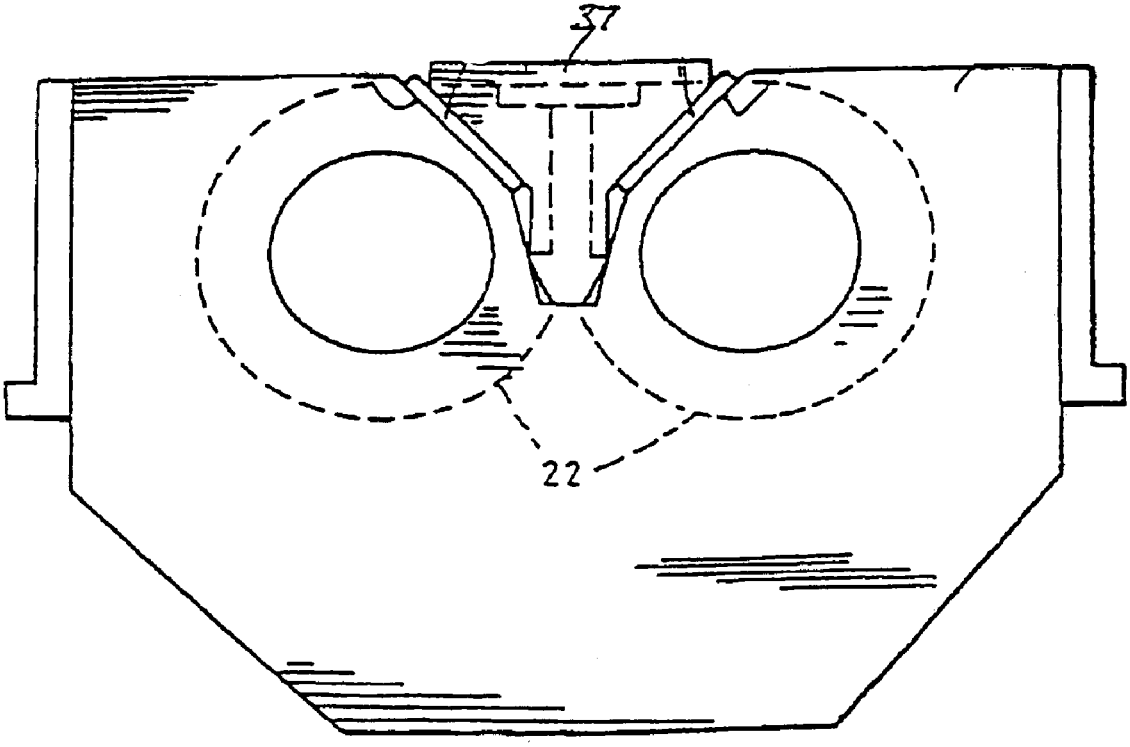
FIG. 3 is an end view of the side dam area shown in FIG. 2.

Referring to FIGS. 1 through 3, the illustrative twin roll caster 11 generally comprises a pair of laterally positioned casting rolls 22 forming a nip 16 therebetween. Molten metal from a ladle 23 is delivered by a metal delivery system 24 to a casting pool above the nip. The delivery system 24 is generally located above nip 16 and may comprise a tundish 25, a removable tundish 26, and at least one core delivery nozzle 27. The molten metal delivered into the casting pool is supported by the casting surfaces of the casting rolls 22 and constrained at the ends of rolls 22 by a pair of opposing side dams 35. Through a wall section 41, side dams 35 are applied to stepped ends of the rolls 22 by a pair of hydraulic cylinders 36 via thrust rods 50 connected to side dam holders 37. Twin roll caster 11 may be of the kind illustrated in U.S. Pat. Nos. 5,184,668 and 5,277,243, to which reference may be made for appropriate construction details which form no part of the present invention.

Because side dams 35 are placed against rolls 22, side dams 35 are subject to significant wear and routinely require replacement. Replacement requires temporarily shutting down operation of cast roller 11, draining the casting pool, and retracting cylinders 36 so to allow access to the side dams 35 via an opening 69. Replacement side dams may also be preheated to improve recovery time and prevent thermal shock to the refractories. Replacing side dams 35 impart significant costs, which includes the costs associated with replacement dams, preheating, lost pool metal, labor, and lost cast strip production (via cast roller down time). Dams 35 maybe replaced when worn to specified limits, or based upon a desired service cycle. Dams 35 may be monitored by transducers mounted upon the cylinders 36.

Side dams 35 experience a higher rate of wear during an initial bedding-in period. It has been found that as the cast pool is being filled at the start of casting, snake eggs (portions of solid metal) form and apply resistive forces against the side dam additional to the forces generated by the cast pool itself. Snake eggs form along the side dam/casting roll interface and the casting pool (known as the triple point) due to the higher rate of heat loss attributed to the triple point region. To resist the increased forces generated by the snake eggs, the cylinders 36 must use higher forces to maintain the side dams 35 against the rolls 22 such that the side dams exert a force against the rolls less than 3.0 kg/cm$^2$ but more than 1.25 kg/cm$^2$. This force exerted by the side dam against rolls 22 may be greater than 1.5 kg/cm$^2$ or greater than 1.9 kg/cm$^2$. For example, the force could be 1.97 kg/cm$^2$. However, these increased forces cause additional wear. Therefore, after reaching the target pool height, or after casting becomes stable, the side dam application force against the rolls 22 (as applied via the cylinders) is reduced to below 1.25 kg/cm$^2$ to reduce wear of the side dams against the end surfaces of the casting rolls while resisting ferrostatic pressure from the casting pool. After the target pool height is reached, the pressure exerted by the side dams against the end surfaces of the casting rolls is below 0.5 kg/cm$^2$ or below 0.25 kg/cm$^2$.

Figure 4:
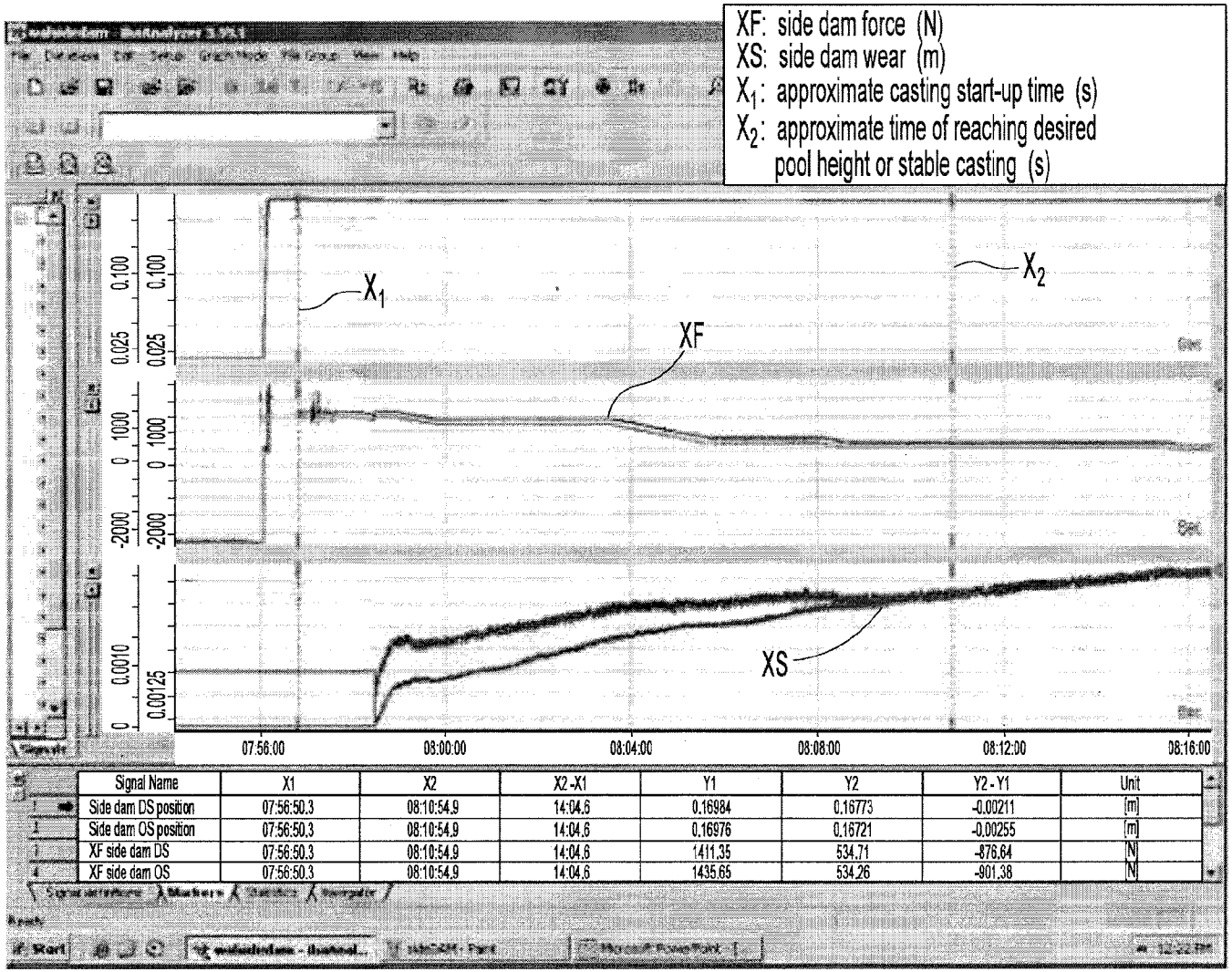
FIG. 4 is a chart measuring the side dam forces during operation of a roll caster in accordance with the present invention.

FIG. 4 sets forth graphs showing the side dam position, side dam wear, and side dam force (the amount of force applied by the side dams against the casting rolls) as measured over time, beginning at casting start up. XF identifies a pair of lines measuring the side dam force for each side dam 22. XS identifies a pair of lines measuring the amount of wear for each side dam. The chart below the graphs provides specific measurements at times $X_1$ (approximately casting start up) and $X_2$ (approximately the time when reaching a desired pool height or stable casting). According to the present embodiment, the force exerted by the side dams 35 against rollers 22, at start up is between 1400 and 1450 Newtons (N) (2 and 2.1 kg/cm$^2$). Once reaching the desired pool height (175 mm) or casting stabilization, the side dam force should be reduced to between 500 and 550 N (between 0.7 to 0.8 kg/cm$^2$ within the cylinder). Generally, the initial force may be as high as 2100 N (3.0 kg/cm$^2$), while the minimum reduced force may be as low as 100 N (0.15 kg/cm$^2$); however, these limits can increase or decrease depending upon the actual side dam design and/or material used therefore, the depth and/or volume of the casting pool, or the quantity and/or size of snake eggs in the casting pool (as the existence snake eggs may be controlled or escalate via other means or conditions). In the embodiment shown in FIG. 4, the maximum and minimum force limits are approximately 1750 N (2.5 kgf/cm$^2$) and 130 N (0.19 kgf/cm$^2$), respectively. Generally, from high to low force levels, the wear rates will generally vary between about 0.0016 and 0.00026 mm/sec.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A method of continuous casting thin strip comprising the steps of:

a. assembling a pair of casting rolls laterally positioned to form a casting pool of molten metal supported on casting surfaces of the casting rolls confined by side dams adjacent opposite ends surfaces of the casting rolls, and a nip between the casting rolls through which cast strip can discharge downwardly, b. at the start of a casting campaign, pressing the side dams against the end surfaces of the casting rolls such that the side dams exert a pressure against the end surfaces of the casting rolls of less than 3.0 kg/cm$^2$ but more than 1.25 kg/cm$^2$, c. after a target casting pool height is reached, reducing the pressure exerted by the side dams against the end surfaces of the casting rolls to below 1.25 kg/cm$^2$ to reduce wear of the side dams against the end surfaces of the casting rolls while resisting ferrostatic pressure from the casting pool.

2. The method of continuous casting thin strip as claimed in claim 1 where after the target casting pool height is reached, the pressure exerted by the side dams against the end surfaces of the casting rolls is reduced to below 0.5 $kg/cm^2$.

3. The method of continuous casting thin strip as claimed in claim 1 where after the target casting pool height is reached, the pressure exerted by the side dams against the end surfaces of the casting rolls is reduced to below 0.25 $kg/cm^2$.

4. The method of continuous casting thin strip as claimed in claim 1 where at the start of the casting campaign, the pressure exerted by the side dams against the end surfaces of the casting rolls is greater than 1.5 $kg/cm^2$.

5. The method of continuous casting thin strip as claimed in claim 1 where at the start of the casting campaign, the pressure exerted by the side dams against the end surfaces of the casting rolls is greater than 1.9 $kg/cm^2$.

6. The method of continuous casting thin strip as claimed in claim 1 where the wear rate of the side dams during casting after the target pool height is reached ranges from 0.0001 mm/sec to 0.005 mm/sec.

7. The method of continuous casting thin strip as claimed in claim 1 where the wear rate of the side dams during casting after the target pool height is reached ranges from 0.0008 mm/sec to 0.0032 mm/sec.

8. The method of continuous casting thin strip as claimed in claim 1 where the wear rate of the side dams during casting after the target pool height is reached ranges from 0.005 mm/sec to 0.001 mm/sec.

* * * * *